US005697119A

United States Patent [19]

Mussalo

[11] Patent Number: 5,697,119

[45] Date of Patent: Dec. 16, 1997

[54] ACCESSORY FOR A VACUUM CLEANER

[76] Inventor: Sisko Tuulikki Mussalo, Takakyläntie 81, 48310 Kotka, Finland

[21] Appl. No.: 590,384

[22] Filed: Jan. 25, 1996

[30] Foreign Application Priority Data

Jan. 30, 1995 [FI] Finland ..... U950047 U

[51] Int. Cl.[6] ..... A47L 5/30; A47L 11/292

[52] U.S. Cl. ..... 15/320; 15/321; 15/383

[58] Field of Search ..... 15/320, 322, 321, 15/383

[56] References Cited

U.S. PATENT DOCUMENTS

| | | | |
|---|---|---|---|
| 2,763,886 | 9/1956 | Brown, Jr. et al. . | |
| 3,267,511 | 8/1966 | Meyerhoefer . | |
| 3,482,276 | 12/1969 | Fillery . | |
| 3,906,585 | 9/1975 | Mattsson . | |
| 3,942,963 | 3/1976 | Tevis . | |
| 3,966,444 | 6/1976 | Clowers et al. . | |
| 4,159,555 | 7/1979 | Schneider | 15/320 X |
| 4,167,799 | 9/1979 | Webb | 15/322 X |
| 4,360,946 | 11/1982 | Marshall et al. | 15/321 |
| 4,369,544 | 1/1983 | Parisi | 15/320 |
| 4,433,451 | 2/1984 | Parisi . | |
| 4,490,882 | 1/1985 | Wells . | |
| 4,845,794 | 7/1989 | Korski et al. | 15/320 X |
| 5,018,240 | 5/1991 | Holman . | |
| 5,241,724 | 9/1993 | Lim . | |

FOREIGN PATENT DOCUMENTS

| | | | |
|---|---|---|---|
| 32360 | 7/1981 | European Pat. Off. | 15/321 |
| 0432455A1 | 11/1990 | European Pat. Off. . | |
| 0447627A1 | 11/1990 | European Pat. Off. . | |
| 0320735B1 | 7/1993 | European Pat. Off. . | |
| 0339323B1 | 7/1993 | European Pat. Off. . | |
| 0437466B1 | 12/1993 | European Pat. Off. . | |

*Primary Examiner*—Chris K. Moore

[57] ABSTRACT

A cleaning device for connecting to a wet vacuum cleaner is disclosed. The device includes a mouth piece with a rotably mounted cleaning roller and a liquid reservoir coupled to a manifold nozzle for wetting the roller. In operation, the liquid wets the roller, the roller rotates to scrub a surface and the mouth piece is connected to an operating wet vacuum cleaner so that air is drawn through the mouth piece along with debris directly from the surface and from the roller.

5 Claims, 1 Drawing Sheet

ACCESSORY FOR A VACUUM CLEANER

BACKGROUND OF THE INVENTION

1. Field of the Invention

The present invention relates to a vacuum cleaner accessory.

2. Description of the Related Art

It is problematic in cleaning various floor and other surfaces that a variety of cleaning procedures have to be carried out one after the other until the final result is satisfactory. Careful cleaning work done this way is quite laborious and awkward. By way of example, the course of normal, careful cleaning is the following. First, all loose dirt is removed as completely as possible from the surface to be cleaned. Usually this is done mechanically, by vacuum cleaning or sweeping with a brush. Thereafter, the surface to be cleaned is washed with a detergent solution by utilizing various brushes, or scouring sponges and/or scouring cloths which have a surface ranging from rough to soft. Thereafter, the surface to be cleaned is rinsed and dried. The final result yields a cleaner surface. However, a great number of different cleaning implements have been used; they have been moved back and forth between the cleaning cupboard and the place to be cleaned; containers for cleaning solutions and containers for rinsing water have been filled and emptied, etc. Besides taking plenty of time, moving to and fro between the cleaning cupboard, water supplies/sinks and the place to be cleaned the work is also physically heavy and therefore very frustrating.

For example, in industrial and other establishments, special cleaning machines have been used for cleaning large floor surfaces. These machines first pick up the loose dirt and thereafter effect wet washing. It is characteristic of these devices that they are independent appliances, being provided with a large container for water/washing fluid as well as a container for dirty wash water. They are also very massive and heavy. However, they are highly applicable in the above described surroundings for which they have been designed, i.e., industrial halls, long corridors, etc.; in other words, cleaning open and large floor surfaces. In these surroundings, the advantages of these devices are apparent, whereas the drawbacks caused by size and weight are not too disturbing. It is also evident that due to the high price of these devices, they are only used in places where the floor surfaces to be cleaned are sufficiently large and are made of materials similar to each other, for example, concrete or tile.

U.S. Pat. Nos. 3,267,511 and 2,763,886 and EP patent 0 432 455 disclose sucking of wet dirt from moist surfaces. At the same time, wash water or equivalent is picked up if the water has been spilled onto the floor surface on purpose. The task of these vacuum cleaner accessories is, however, only to filter off the water entering the suction pipe so that the moisture being picked up from the floor surface is prevented from damaging the sensitive electric appliances of the vacuum cleaner and causing hazardous situations to the operator. It is self-evident that moisture in combination with supply current is hazardous.

EP patent 0 437 466 discloses a cleaning device for carpets, which is an accessory for a vacuum cleaner. This device is moved back and forth on a carpet, whereby a liquid cleaning solution moistens a roller made from soft material such as foam. The dirt on the carpet is seized by the cleaning solution and is sucked into the vacuum cleaner via suction slots on the sides of a mouth piece of the accessory. The space for washing solution and the foam roller impregnated with washing solution is not in connection with the suction slots on the sides of the mouth piece. The object of this carpet cleaning device according to EP 0 437 466 is to detach dirt from a carpet by means of suitable chemicals, to entrain the dirt into the cleaning solution and then to suck the dirty cleaning solution into the vacuum cleaner.

SUMMARY OF THE INVENTION

It is an object of the present invention to provide a vacuum cleaner accessory, which enables efficient and time-saving cleaning of various bare surfaces such as floors, tile walls, etc.

The cleaning work done with the apparatus according to the invention is also physically light.

The present invention combines the following elements:

- a vacuum cleaner, which is provided with means known per se for removing moisture from suction air,
- a motor driven by a suitable electric supply,
- a rotating roller driven by the motor,
- a surface material of a cleaning cloth arranged on the roller surface, which surface material is replaceable and has been chosen according to the surface material of the place to be cleaned (parquet, brick, etc.) and according to how dirty it is, and
- moistening means for the cleaning cloth, for only moistening the surface of the cleaning cloth, not making it wet.

By combining these factors, a smoothly moving, electrically safe cleaning apparatus is provided which is highly applicable for households and has an excellent cleaning efficiency, effecting all necessary cleaning phases at a time.

DETAILED DESCRIPTION OF THE PREFERRED EMBODIMENT

Figure 1:
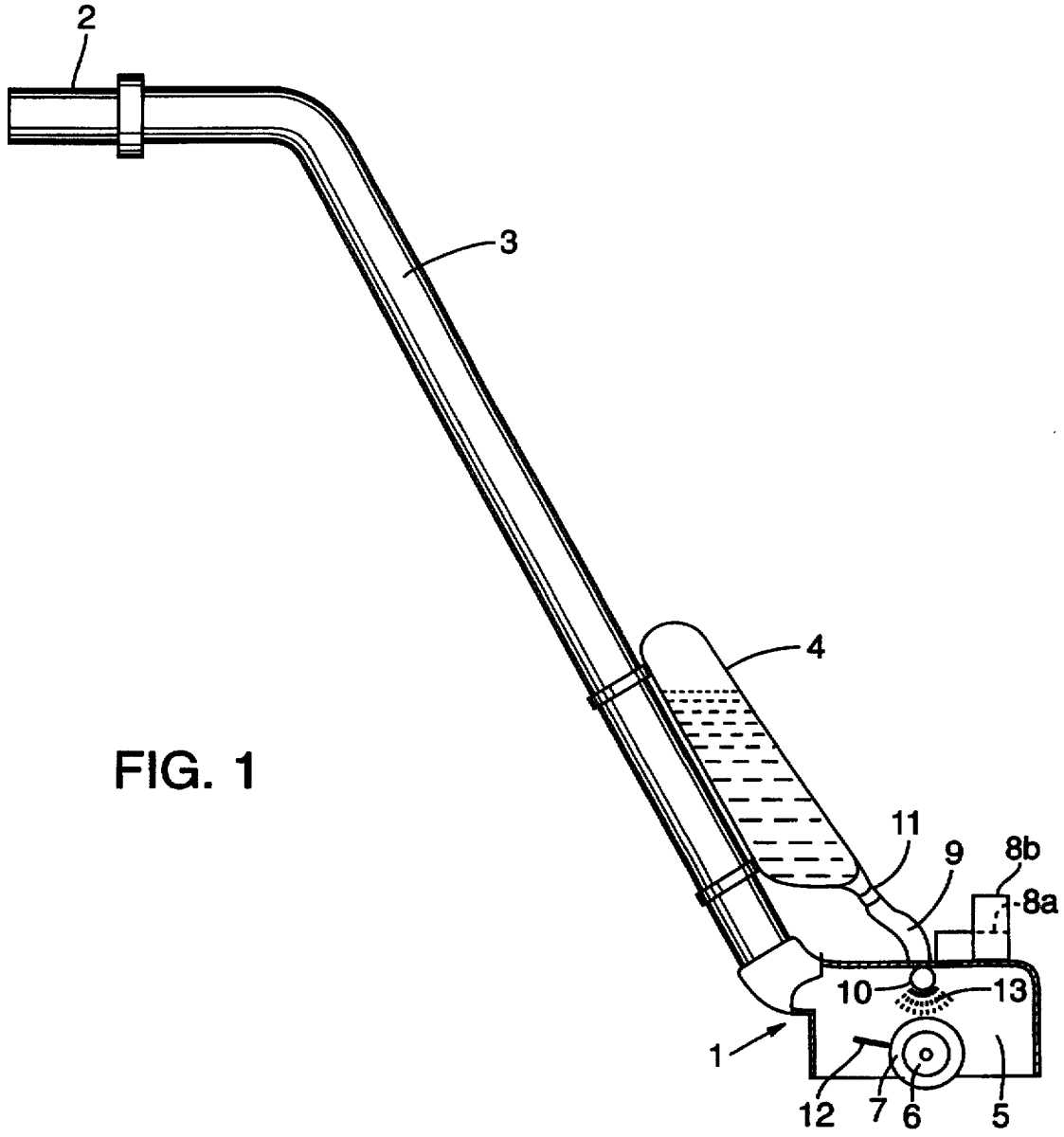
FIG. 1 is a side elevation view and partial section of a vacuum cleaning attachment of the present invention mounted on an exemplary vacuum cleaner tube.

A preferred embodiment of an apparatus according to the invention is described below with reference to the accompanying drawing, in which the apparatus of the invention is shown schematically and partly as a section view. This accessory apparatus attaches to a filtering means (not shown) known per se, for removing moisture from suction air taken into a vacuum cleaner. The accessory apparatus comprises a mouth piece 1, which is attached, in a manner known per se, to a vacuum cleaner suction hose 2 or to a stiff suction pipe 3 which is an extension of the suction hose 2, and a cleaning liquid container 4. This cleaning liquid container may be attached to the stiff suction pipe 3, or it may be fitted directly to the mouth piece itself, which is readily detachable and may be attached to the vacuum cleaner.

The mouth piece is provided with a suction slot 5, wherethrough the vacuum cleaner sucks air and dirt. In connection with the suction slot a roller 6 is provided, which is coated with a detachable cleaning cloth 7. The surface material of the cleaning cloth is chosen according to the surface type and dirt of the surface to be cleaned. The roller is fixed to the mouth piece so that it is readily detachable therefrom. Preferably, the cleaning cloth is attached to the roller, with a stick-on-label mechanism, whereby it is easy to replace and wash. The roller is rotated by a power means, such as a battery-driven motor (8*a*) being provided with necessary power transmission means for rotation of the roller, such as transmission belts, pinions, or equivalent (not shown). A battery 8b for operating the motor, is detachable and easily replaceable with a new, charged battery, so that the cleaning work does not involve unnecessary breaks. By using a battery as an electric supply, safety regulations for operating in moist conditions are met. The battery-driven motor rotates the cleaning roller all the time, whereby both mechanical and chemical active cleaning, characteristic of the invention, takes place efficiently. The apparatus according to the invention may thus be kept in place or almost in place during cleaning of very difficult stain.

In the apparatus according to the invention, the roller may be moistened with cleaning liquid, which is contained in the cleaning liquid container 4. This container, preferably attached to the vacuum cleaner arm, is provided with a hose 9 leading to a separate nozzle means (nozzle pipe) 10 having a plurality of nozzles 13 which evenly distributes the liquid onto the cleaning cloth on the roller surface. The purpose of the moistening means, as its name implies, is to moisten the cleaning cloth, not to make it wet or saturated. The cleaning liquid may be either mere water or a suitable cleaning liquid, which contributes to removing dirt from the surface to be cleaned. The hose 9 leading from the cleaning liquid container to the mouth piece is provided with a suitable closing mechanism 11, which is opened only when it is necessary to dispense the liquid. When the dirt particles become loose from the surface to be cleaned, they are, depending on their size, either taken via the suction slot into the vacuum cleaner or absorbed in the cleaning cloth itself, which is replaced with a clean one when necessary.

The mouth piece may be provided with two rollers, whereby the operation of the cleaning apparatus may be further intensified. By using two rollers, the surface materials or roughness of the cloths may be chosen so that the surface material of the cleaning cloth attached to the first (forward) roller is rougher, whereby it efficiently removes dirt which is hard to get loose, and the surface material of the second (rearward) roller is finer, whereby it is ensured that it also removes finer dirt from the surface to be cleaned. Dirt particles from both cleaning cloths are sucked via the mouth piece into the vacuum cleaner. Very fine dirt, for example, fluid adheres to the cleaning cloth itself, which may be cleaned and replaced when necessary.

The mouth piece may also be so constructed that it can be used as an ordinary carpet/floor nozzle. In this case, the readily detachable rollers are simply removed, and a member attached to the mouth piece, which member is provided with bristles, may be taken into use according to the type of floor covering. Thus, the arrangement according to the invention serves as both a washing accessory and an ordinary carpet/floor nozzle.

Instead of the battery-driven motor used for rotating the roller(s), the voltage supply of the vacuum cleaner itself may also be used, which may be adapted with a transformer to a sufficiently low operation voltage to meet the safety requirements set on electric appliances used in moist conditions.

The cleaning liquid container may be attached directly to the mouth piece, thereby making the mouth piece into a compact unit. The cleaning liquid container may also be pressurized, whereby cleaning of vertical surfaces or even ceilings is easy.

The invention has been described above by disclosing only a preferred embodiment thereof, but it is by no means intended to limit the invention. Many alternative and optional constructions and modifications are feasible within the inventive scope defined in the accompanying claim.

I claim:

1. An accessory for a vacuum cleaner equipped with a suction hose and filtering means for removing moisture from the suction air being taken into the vacuum cleaner, characterized in that the accessory comprises:

(a) a mouth piece having a suction slot connected to the suction hose of the vacuum cleaner;

(b) a cleaning roller disposed in the suction slot of the mouth piece and having a cleaning cloth detachably attached to the surface of the roller;

(c) moistening means for moistening the cleaning cloth, comprising a cleaning liquid container, closing mechanism, hose, and nozzle means; and (d) a motor for continuously rotating the roller, and power transmission means interconnecting the motor and roller.

2. A cleaning device, comprising:

(a) a mouth piece adapted to be coupled to a vacuum source, the mouth piece including a suction opening for receiving fluid;

(b) a cleaning roller rotatably coupled to the mouth piece proximate the suction opening, the roller supporting the mouth piece above a surface to be cleaned;

(c) a liquid reservoir coupled to a dispensing orifice, the orifice located so as to dispense liquid from the reservoir onto the roller; and (d) a motor for rotating the roller whereby the roller rotates continuously and cleans the surface to be cleaned.

3. The cleaning device of claim 2 further comprising a vacuum source, the mouth piece is coupled to the vacuum source, and fluid is received through the suction opening simultaneously as the roller rotates.

4. The cleaning device of claim 2 further comprising a cloth detachably coupled to the roller.

5. The cleaning device of claim 2 wherein the orifice comprises a plurality of nozzles so as to distribute the liquid along the roller.

* * * * *